US006482067B1

(12) United States Patent
Pickens

(10) Patent No.: US 6,482,067 B1
(45) Date of Patent: Nov. 19, 2002

(54) REGISTERED PEDIGREE STUFFED ANIMALS

(76) Inventor: David L. Pickens, 79 Mikaweli St., Honolulu, HI (US) 96825

( * ) Notice: Subject to any disclaimer, the term of this patent is extended or adjusted under 35 U.S.C. 154(b) by 0 days.

(21) Appl. No.: 09/660,260

(22) Filed: Sep. 12, 2000

Related U.S. Application Data

(60) Provisional application No. 60/177,664, filed on Jan. 27, 2000.

(51) Int. Cl.[7] ..... A63H 3/00
(52) U.S. Cl. ..... 446/268
(58) Field of Search ..... 446/369, 370, 446/371, 372, 385, 268

(56) References Cited

U.S. PATENT DOCUMENTS

| | | | | | |
|---|---|---|---|---|---|
| 1,177,908 | A | * | 4/1916 | Teeters | 38/4 |
| 1,543,351 | A | * | 6/1925 | Webb | 446/369 |
| 3,407,503 | A | | 10/1968 | Grant et al. | |
| 4,197,670 | A | | 4/1980 | Cox | |
| 4,249,337 | A | * | 2/1981 | Eason | 446/372 |
| 4,795,397 | A | | 1/1989 | Stevens | |
| 4,818,233 | A | * | 4/1989 | Behan | 434/245 |
| 4,883,442 | A | | 11/1989 | Kaplan | |
| 5,004,442 | A | | 4/1991 | Lemelson et al. | |
| 5,129,853 | A | * | 7/1992 | Bowling | 446/372 |
| 5,299,968 | A | * | 4/1994 | Bennett | 446/369 |
| 5,597,339 | A | | 1/1997 | Spector | |
| 6,206,750 | B1 | * | 3/2001 | Barad et al. | 446/268 |

* cited by examiner

*Primary Examiner*—Jacob K. Ackun
*Assistant Examiner*—Faye Francis
(74) *Attorney, Agent, or Firm*—Richard C. Litman

(57) ABSTRACT

The registered pedigree stuffed animals of the present invention are stuffed toy animals which are made according to a method which simulates the biological laws of inheritance and which provides documentation certifying the pedigree status of the toy animals, both for educational, recreational and aesthetic purposes. According to the method a pair of opposite sex "parent" toy animals are sold together with a serial number by which the parent's genotype and phenotype may be identified. The owner or owners of the "parent" toy animals may register the parents with the manufacturer and subsequently request "breeding" of the animals, whereupon the manufacturer makes at least one "offspring" toy animal randomly selected from a litter having phenotypes determined according to the registered genotypes of the parents and the Mendelian laws of inheritance. In an alternative embodiment, the parent's serial numbers may encode six traits, and one offspring may be produced according to the laws of inheritance.

1 Claim, 4 Drawing Sheets

REGISTERED PEDIGREE STUFFED ANIMALS

CROSS-REFERENCE TO RELATED APPLICATION

This application claims the benefit of U.S. Provisional Patent Application Ser. No. 60/177,664, filed Jan. 27, 2000.

BACKGROUND OF THE INVENTION

1. Field of the Invention

The present invention relates to a method of creating bloodlines for toy animals.

2. Background of the Invention and Discussion of Related Art

Since the dawn of civilization, man has selectively bred, and cross-bred plants and animals to create varieties suited to specific needs. For example, dogs have been bred for aesthetically appealing traits. Hence, today we have tremendous variety among dog breeds. Indeed, beauty is in the eye of the beholder. Some owners prefer the pug's pushed in face. Other owners desire the distinctive ridge on the back of the Rhodesian ridgeback.

The mechanism that makes selective breeding possible was only discovered in the 19th century. Gregor Mendel, an unassuming monk, meticulously gathered massive quantities of data on pea plants. His subsequent analysis revealed the Mendelian mechanism for genetics.

The present invention is a method for "breeding" toy animals. The method provides for a "genetic" link between a series of toy animals, wherein owners participate in the selective breeding of their toy animals. The owner decides which toys to breed. Thus, according to the present method, the owner's aesthetic preferences will surface in subsequent generations of the toys.

Toys with distinctive appearances have been the subject of earlier patents. The prior art, discussed below, illustrates previous developments.

U.S. Pat. No. 3,407,503, issued on Oct. 29, 1968, to Allen Grant and Leo Monahan, discloses a sectionally formed figure with identifying indicia on the sections. In its properly assembled state, an indicating word appears on the figure's surface. The various sections can be rearranged to form nonsensical words, and a grotesque figure. The figure does not have a unique genetic identity. Furthermore, the figure has neither progenitors, nor offspring.

Toys featuring a mother doll, and a baby doll have been the subject of earlier patents.

U.S. Pat. No. 4,197,670, issued on Oct. 6, 1978, to Zula B. Cox, discloses a doll of the stuffed variety. The doll includes a trunk, and the trunk has a cavity therein. A baby doll is removably carried within the cavity.

U.S. Pat. No. 4,883,442, issued on Nov. 28, 1989, to Ida B. Kaplan, discloses a pregnant mother doll with a separable baby doll.

Neither the Cox patent, nor the Kaplan patent suggest shared physical traits between the mother doll, and the baby doll. Furthermore, there is no reference to a father doll. Finally, the dolls are limited to representations of human mothers with one offspring.

U.S. Pat. No. 5,597,339, issued on Jan 28, 1997, to Donald Spector, discloses an animal-like stuffed toy figure with a closable internal pouch in which is received a latent offspring. Here, the concept of mother and offspring has been expanded to include a species other than human.

However, the mother and offspring do not share unique physical features. Nothing suggests a genetic relationship, other than one that may be had with a random member of the species. Additionally, no reference is made to a father doll.

Toy dolls which copy physical traits from a primary, unique template have been the subject of earlier patents.

U.S. Pat. No. 4,795,397, issued on Jan. 3, 1989, to Betty B. Stevens, discloses a doll that is a "twin" of a human newborn. The doll emulates a human newborn's palm and foot prints, as well as the newborn's actual weight, and length. Vital statistics including date of birth, and name are also inscribed on the doll. The Steven patent merely creates a model from a living prototype. The Steven patent pertains to asexual reproduction. There is no suggestion of heritable traits. The Steven patent appears to suggest human cloning.

U.S. Pat. No. 5,004,442, issued on Apr. 2, 1991, to Jerome and Dorothy Lemelson, discloses a series of dolls representative of the same person at different stages of development. There is no suggestion of these traits being inherited from previous generations. Additionally, there is no suggestion that these traits can be passed to subsequent generations.

None of the above inventions and patents, taken either singly or in combination, is seen to describe the instant invention as claimed.

SUMMARY OF THE INVENTION

The registered pedigree stuffed animals of the present invention are stuffed toy animals which are made according to a method which simulates the biological laws of inheritance and which provides documentation certifying the pedigree status of the toy animals, both for educational, recreational and aesthetic purposes. According to the method a pair of opposite sex "parent" toy animals are sold together with a serial number by which the parent's genotype and phenotype may be identified. The owner or owners of the "parent" toy animals may register the parents with the manufacturer and subsequently request "breeding" of the animals, whereupon the manufacturer makes at least one "offspring" toy animal randomly selected from a litter having phenotypes determined according to the registered genotypes of the parents and the Mendelian laws of inheritance. In an alternative embodiment, the parent's serial numbers may encode six traits, and one offspring may be produced according to the laws of inheritance.

Accordingly, it is a principal object of the invention to establish a system for the breeding of toy animals.

It is a further object of the invention to allow owners to participate in the propagation of aesthetically pleasing toy animals.

It is yet another object of the invention to teach principles of genetics.

Still another object of the invention is to provide registered pedigree stuffed animals which simulate the method of pedigree breeding and registration of domestic animals and sporting livestock for educational, recreational and aesthetic purposes.

These and other objects of the present invention will become readily apparent upon further review of the following specification and drawings.

DETAILED DESCRIPTION OF THE PREFERRED EMBODIMENTS

Figure 1:
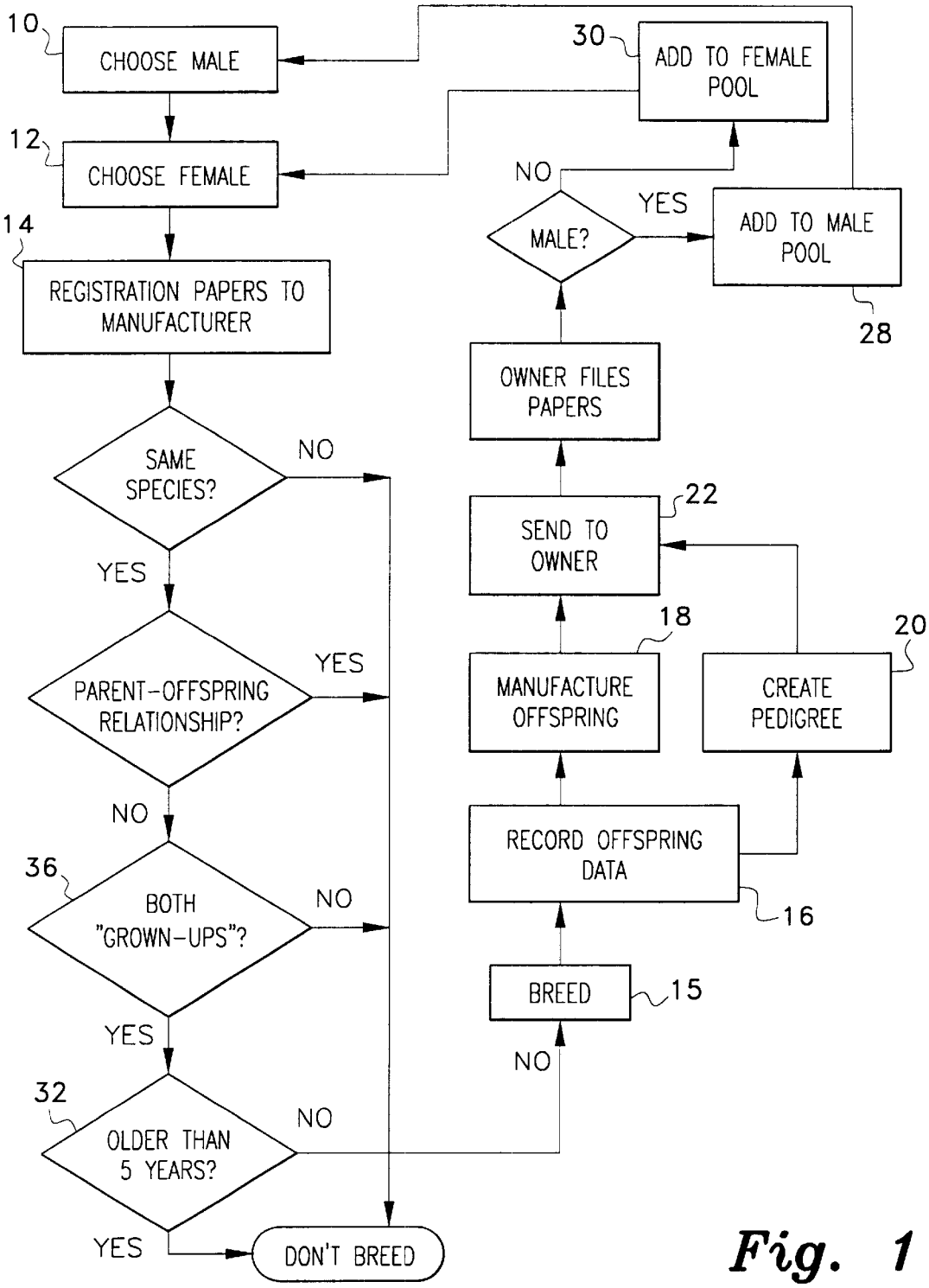
FIG. 1 is a flow chart highlighting the general method of propagation and establishing bloodlines.

The present invention is directed to a method of creating bloodlines for toy animals. The general steps of the method will be discussed with reference to the flow chart shown in FIG. 1.

First, the manufacturer creates a parent genotype for each toy. The parent genotype generally consists of a pair of genes for each trait, each pair reflecting a contribution from a theoretical mother and father toy animal. The manufacturer records each parent genotype in a computer data base.

Next, the manufacturer decodes the parent genotype to reveal a parent phenotype, or genetically determined physical appearance for each trait in the genotype. The parent phenotype is recorded in the manufacturer's data base. The genotype and phenotype are paired, and assigned a serial number by the manufacturer.

The manufacturer constructs a parent toy. The phenotype for each trait dictates the parent toy's appearance. The parent toy is issued documentation including a pedigree with its corresponding serial number.

The manufacturer sells the parent toy 10 to a first owner. A first owner may buy an opposite-sex, parent toy 12 for breeding. Alternatively, the first owner will contact a second owner, who owns an opposite-sex, parent toy 12.

Prior to breeding the parent toys must be registered 14. Each parent toy 10 is sold with a registration card including an owner registration number and the parent toy's 10 serial number, which may be encoded on the registration card by bar code for ease in handling documentation. Registration 14 involves sending the registration card with the owner's registration number, the parent toy's serial number, and an owner created name to the manufacturer. This information may be forwarded either by mail, by FAX, or via the Internet (preferably by attaching a scanned image of the registration card to e-mail or Internet FAX for quicker response, although manual entry of the registration number and serial number may be used in default of such capability). The manufacturer records the registration information in a pedigree data base. An owner may register the parent toy at the time of breeding 15. Alternatively, registration 14 may occur prior to breeding 15.

"Breeding" 15 occurs following registration of both parent toys 14. Breeding 15 produces an offspring genotype. The manufacturer records and decodes the offspring genotype. Decoding the genotype results in a phenotype. The manufacturer records the phenotype. Next, the manufacturer assigns and records an offspring serial number 16. The serial number corresponds to the offspring's paired genotype and phenotype.

The manufacturer constructs an offspring toy as directed by the offspring phenotype 18. At this point, the manufacturer creates a pedigree 20. The pedigree features the offspring toy, and several generations of the offspring toy's progenitors.

Finally, the manufacturer sends the offspring toy, an ownership registration card with an ownership registration number and an offspring serial number 16, and the offspring's pedigree to the owner 22. The offspring toy may now be registered 14, and bred 15. Thus, toy animals may be propagated ad infinitum.

The present invention contemplates the use of toy dogs, of the stuffed variety, as its principle toy of propagation, although it will be obvious that the method of the present invention is also applicable to other types of toy animals, such as horses. Further, although a preferred manner of practicing the present invention is through the manufacture of stuffed animals, it will be understood that the scope of the present invention extends to other types of toy animals, including plastic, wood, pewter, clay or ceramic models or sculptures, as well as playing cards, paintings and other means of physically or visually embodying or representing toy animals known in the art. Two main embodiments exist, being similar in many respects. The embodiments differ in their mechanisms of transmitting genetic information. The Mendelian mechanism mimics the basic pattern found in nature. The alternative mechanism is fanciful, unique, and unknown to science.

A) Common Features Between Embodiments

Each toy dog will have a unique pedigree 20. The pedigree 20 will go back three generations. The owner can find a complete listing of the entire toy dog population at a web site maintained by the manufacturer on the Internet. The population is divided into pools of males 28, and pools of females 30. Owners may meet via the Internet to breed toy dogs.

Dogs are incapable of being bred after five years 32. Hence, each toy will have a birth date.

The toy dog's offspring is given to the owner as a puppy. The owner must contact the manufacturer to obtain "grow-up" papers, and the puppy's tag must be forwarded to the manufacturer. Forwarding the tag ensures that the puppy is allowed to grow-up only once. As a further safeguard, records will be kept of those puppies that have grown-up 36. Subsequent attempts to grow-up the same puppy, will not be permitted.

Figure 4:
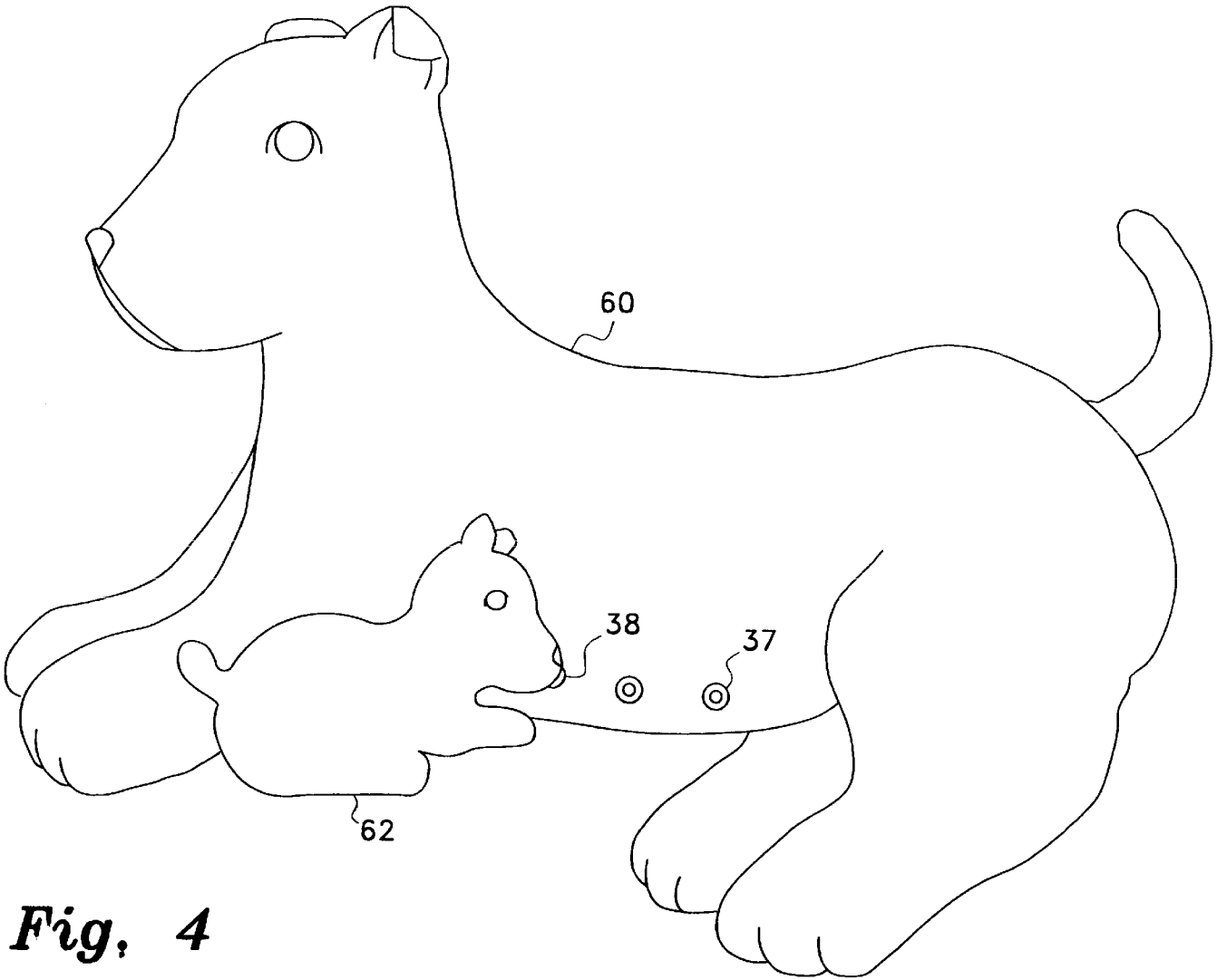
FIG. 4 is an environmental, perspective view of a bitch and her pup according to the present invention.

As shown in FIG. 4, the female toy dogs 60 are anatomically correct, they have teats 37. Their offspring 62, the puppies, will have mouths 38 that can be joined to the mother's teat 37. Likewise, a mother-offspring relationship can be simulated. Any fastener or other releasable means of attachment may be used, but a snap-like is preferred. The mother's teat 37 protrudes, and the offspring's mouth 38 can snap on to it. Alternatively, the mother's teat may be made from hook and loop hastening material, such as Velcro®, and the offspring's mouth may have a mating strip of hook and loop fastening material.

B) Features Unique to the Mendelian Mechanism

Figure 2:
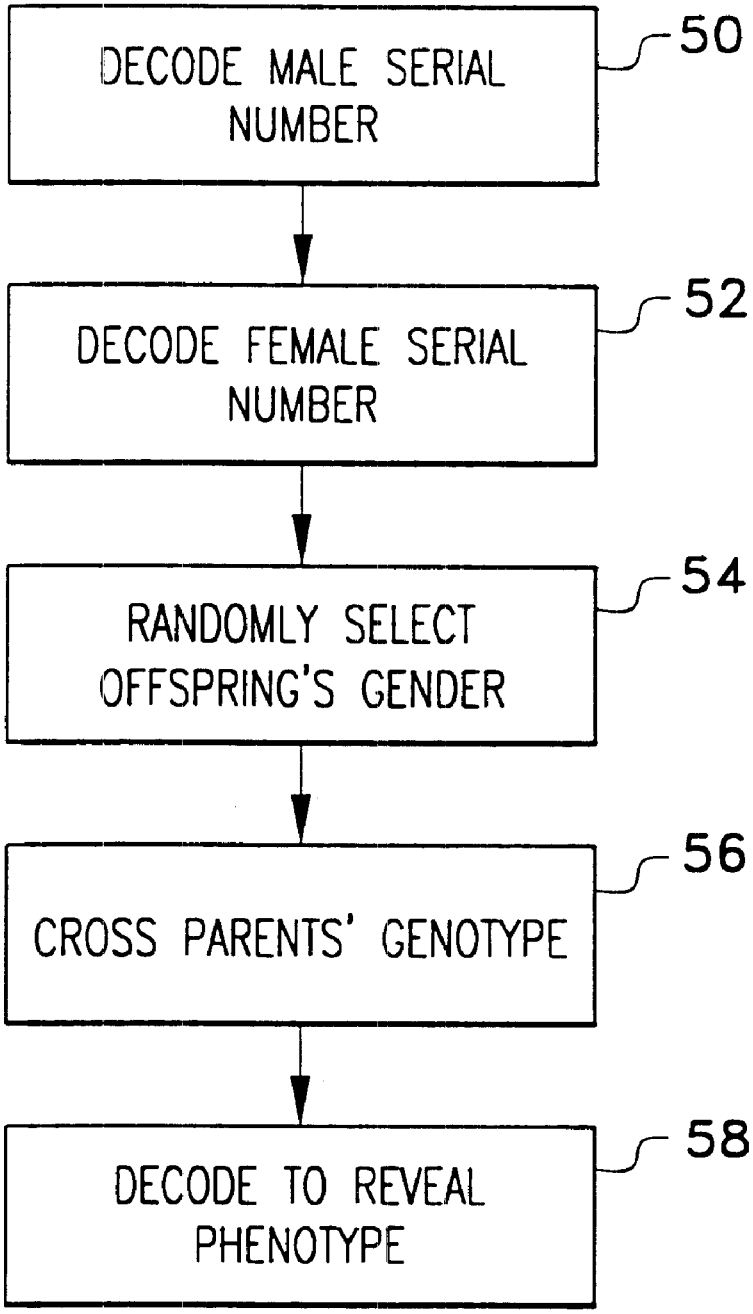
FIG. 2 presents a flow chart illustrating the Mendelian mechanism.

A method of selecting an offspring according to the Mendelian mechanism will now be discussed with reference to FIG. 2. As previously mentioned, the manufacturer has a data base with the genotype of each toy matched to its corresponding serial number. When the owner or owners of a male and female toy animal request breeding of the toy animals, the manufacturer decodes the male serial number 50 and decodes the female serial number 52 to determine the genotypes of the parents as reflected in the manufacturer's registration database. Each genotype consists of a plurality of phenotypes. Each phenotype has a dominant and a recessive state. The two genes act in concert to determine which state is manifested in a particular phenotype. The presence of two recessive genes will result in the expression of the phenotype's recessive state. A dominant gene paired with a recessive gene will result in the expression of the phenotype's dominant state. Two dominant genes will also result in the expression of the phenotype's dominant state. The offspring's gender is selected at random 54. Male 28 and female 30 phenotypes are selected at random, and, in the population, present in equal numbers. The parents' genotypes are crossed 56, i.e., for each trait, a single gene is selected from the male parent's genotype and a single gene is selected from the female's genotype. The offspring's genotype may then be decoded to reveal the offspring's phenotype 58.

Coat length may be either long, or short. A long coat is a dominant trait. A short coat is a recessive trait. The presence of a long coat gene will result in a long coat toy dog. In this example, the toy's phenotype is long coat, and the genotype is either two long coat genes, or a long coat gene paired with a short coat gene. A short coat toy dog must have two short coat genes. Its phenotype would be short coat, and the genotype would be two short coat genes.

Coat color may be black, brown, spotted, or white. A black coat is a dominant trait. A brown coat is also a dominant trait. When a toy dog has one black gene, in combination with one brown gene, the dog's coat will be spotted. A white coat is a recessive trait. A toy dog can only have a white coat if both genes for coat color are white.

Breeding will result in toy dog litters ranging from four to eight. Litter size is determined at random. Owners will be provided with one offspring toy dog, selected at random, from each litter. Remaining litter mates are represented as trading cards. Owners have the option of ordering remaining litter mates to be manufactured into toy dogs. Thus, converting a trading card into a stuffed animal. By contrast, when the alternative mechanism for toy animal genetics is used, litter sizes will be limited to one offspring.

A mutation will occur every third generation. For example, a recessive blue gene will be inserted for coat color, or a hairless gene for coat length. Litter mate, and offspring-parent matings will be prohibited. However, related toy dogs must be mated if the recessive traits are to result in new phenotypes.

C) Features Unique to the Alternative Mechanism

Figure 3:
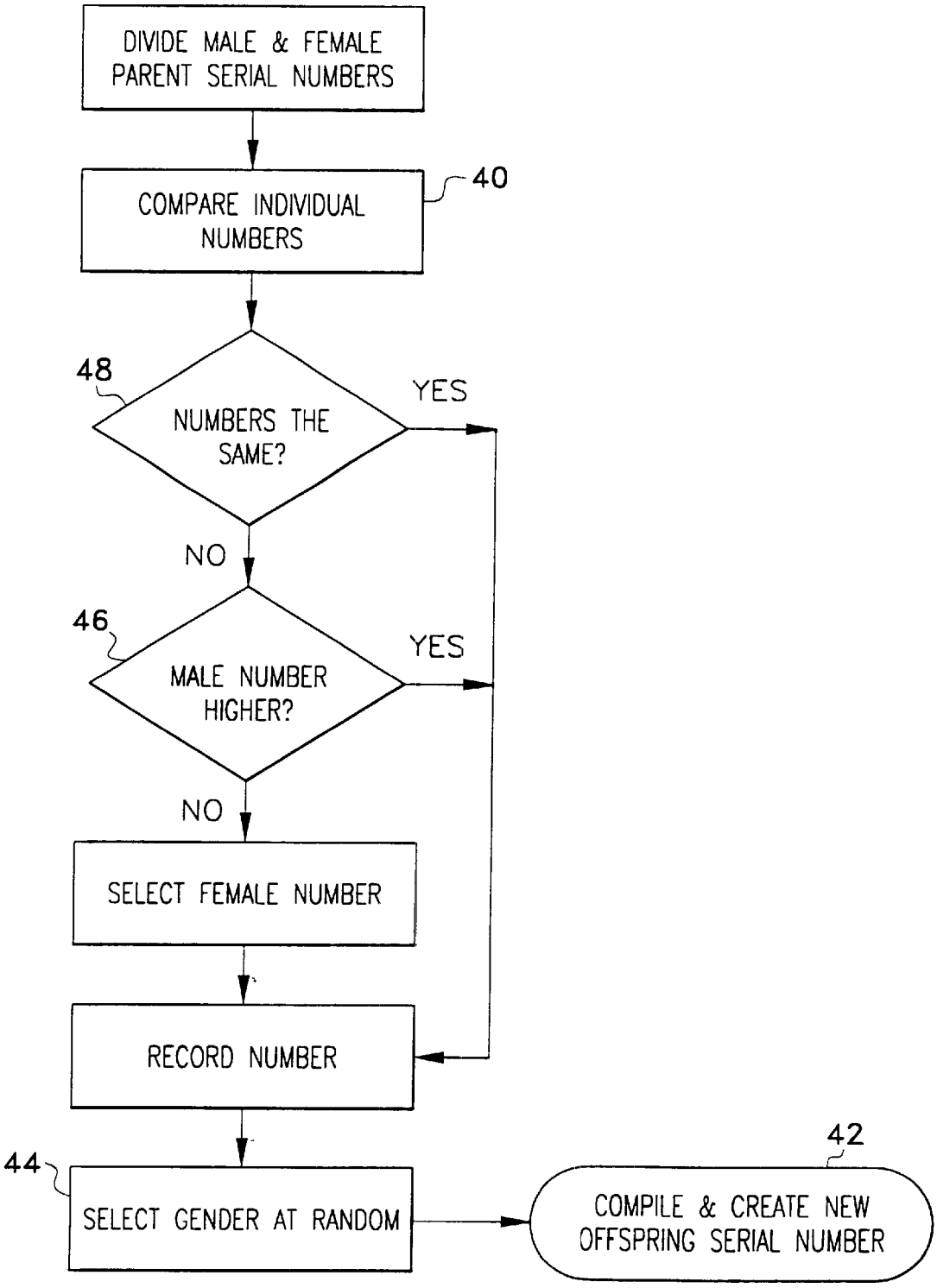
FIG. 3 presents a flow chart illustrating the alternative mechanism.

A second embodiment also contemplates the use of toy dogs, of the stuffed variety, as its principal toy of propagation. This second embodiment, discussed with reference to FIG. 3, illustrates the implementation of the alternative mechanism for toy animal genetics.

The alternative mechanism consists of up to nine different phenotypes for each trait. Each phenotype is represented by a unique, single digit number. When placed in series, after a product code sequence, these numbers complete the toy's serial number.

To breed, the parent's serial numbers are compared 40. Specifically, each single digit phenotype, in the parent's serial number, will be compared to its corresponding single digit phenotype in the opposite-sex parent's serial number. If the digit is the same in both numbers, the digit is recorded 48 in the offspring's serial number. Otherwise, the greater numbered phenotype 46 will be manifested in the next generation. The offspring will both exhibit the greater phenotype, and have that specific number in its serial number 42. Once again, as with the Mendelian method, gender is selected at random 44.

With this embodiment the serial number contains all the genetic information. This scheme merges the phenotype and genotype. The serial number starts with two letters. These letters identify the type of stuffed animal, as well as the particular animal's gender. For example, in a serial number starting with "DM", "D" represents a stuffed dog, and "M" indicates that the particular dog is a male.

In this embodiment, the two letters are followed by a six digit number. These numbers correspond to heritable traits, and the number of digits increases with the addition of each subsequent trait. Here, the toy dogs have six different traits. These traits pertain to the dog's legs, body, eyes, ears, face, and tail. Each trait has nine different phenotypes, with each phenotype assigned a number from one to nine. These single digit numbers determine which traits are passed to subsequent generations. Higher numbers prevail over lower numbers 46. Equal numbers will result in the same number appearing in subsequent generations 48.

The legs, increasing from one to nine, have the following phenotypes: (1) short-hair,black; (2) short-hair, brown; (3) short-hair, tan; (4) short-hair, white; (5) long-hair black; (6) long-hair brown; (7) long-hair, tan; (8) long-hair, white; (9) short-hair, white with black spots.

The body, increasing from one to nine, has the following phenotypes: (1) short-hair,black; (2) short-hair, brown; (3) short-hair, tan; (4) short-hair, white; (5) long-hair black; (6) long-hair brown; (7) long-hair, tan; (8) long-hair, white; (9) short-hair, white with black spots.

The eyes, increasing from one to nine, have the following phenotypes: (1) both black; (2) both brown; (3) both blue; (4) both green; (5) left eye closed, right eye green; (6) left eye closed, right eye black; (7) right eye closed, left eye blue; (8) right eye blue, left eye green; (9) right eye black, left eye brown.

The ears, increasing from one to nine, have the following phenotypes: (1) long and floppy, black; (2) long and floppy, brown; (3) long and floppy, white; (4) short and standing, black; (5) short and standing, brown; (6) short and standing, white; (7) short and standing/bent down at tip, black; (8) short and standing/bent down at tip, brown; (9) short and standing/bent down at tip, white.

The face, increasing from one to nine, has the following phenotypes: (1) short snout, black; (2) short snout, brown; (3) short snout, white; (4) short snout, tan; (5) long snout, black; (6) long snout, brown; (7) long snout, white; (8) long snout, tan; (9) flat snout, brown.

The tail, increasing from one to nine, has the following phenotypes: (1) short-length, black; (2) short-length, brown; (3) short-length, white; (4) medium-length, black; (5) medium-length, brown; (6) medium-length, white; (7) curls-up, black; (8) curls-up brown; (9) curls-up, white.

To illustrate, if one breeds DM959212 with DF939146, their offspring would be DM959246. Only the gender is determined at random 44. All other traits are predictable, as higher numbered traits always dominate.

The alternative method may be preferred because it is easier to implement, and more predictable than the Mendelian method. Furthermore, only one offspring is produced, because, gender aside, all offspring will be identical. Additionally, under this regime, genotypes are a meaningless designation. In essence, the genotype merges into the phenotype. Geneticists have yet to find this alternative mechanism in nature.

It is to be understood that the present invention is not limited to the embodiments described above, but encompasses any and all embodiments within the scope of the following claims.

I claim:

1. A method for making and distributing stuffed toy animals, comprising steps of:

(a) making a first toy animal;

(b) creating a first serial number associated with said first toy animal, the serial number having:

(i) a first character identifying a product line;

(ii) a second character associating a gender with said first toy animal;

(iii) a plurality of trait characters following said second character, each trait character identifying a trait exhibited by said first toy animal;

(c) recording said first serial number in a parent database;

(d) creating a first pedigree paper, the first pedigree paper including said first serial number;

(e) distributing said first toy animal together with said first pedigree paper to a first customer;

(f) making a second toy animal;

(g) creating a second serial number associated with said second toy animal, the serial number having:

(i) a first character identifying a product line;

(ii) a second character associating a gender with said second toy animal, the gender assigned to said second toy animal being opposite to the gender assigned to said first toy animal;

(iii) a plurality of trait characters following said second character, each trait character identifying a trait exhibited by said second toy animal;

(h) recording said second serial number in the parent database;

(i) creating a second pedigree paper, the second pedigree paper including said second serial number;

(j) distributing said second toy animal together with said second pedigree paper to a second customer;

(k) receiving a request from the first and second customers for a toy animal, the request including said first and second serial numbers;

(l) comparing said first and second serial numbers to create a third serial number, the third serial number having:

(i) a first character identifying a product line;

(ii) a second character corresponding to a randomly selected gender;

(iii) a plurality of third serial number, trait characters following the second character, each third serial number trait character being equal to the greater of the corresponding trait character in said first and second serial numbers when said first and second serial number trait characters are unequal, and equal to the corresponding trait character in said first and second serial numbers when said first and second serial number trait characters are equal;

(m) making a third toy animal exhibiting the traits identified by said third serial number;

(n) recording third serial number in database;

(o) creating a third pedigree paper, the third pedigree paper including said third serial number; and (p) distributing the toy animal made in step (m) together with said third pedigree paper to said first and second customers.

* * * * *